US007216374B2

(12) United States Patent
Hassan

(10) Patent No.: US 7,216,374 B2
(45) Date of Patent: May 15, 2007

(54) SMART TOILET SEAT

(76) Inventor: Shawky Hassan, 1146 Linden Rd., Flint, MI (US) 48532

( * ) Notice: Subject to any disclaimer, the term of this patent is extended or adjusted under 35 U.S.C. 154(b) by 33 days.

(21) Appl. No.: 11/099,009

(22) Filed: Apr. 5, 2005

(65) Prior Publication Data

US 2005/0229301 A1 Oct. 20, 2005

Related U.S. Application Data

(60) Provisional application No. 60/559,627, filed on Apr. 5, 2004.

(51) Int. Cl.
*A47K 3/20* (2006.01)
*A47K 4/00* (2006.01)
*E03D 9/08* (2006.01)

(52) U.S. Cl. ..... 4/420.4; 4/217; 4/234; 4/237

(58) Field of Classification Search ..... 4/213, 4/217, 234, 237, 238, 420.2, 420.4, 447
See application file for complete search history.

(56) References Cited

U.S. PATENT DOCUMENTS

| | | | | |
|---|---|---|---|---|
| 3,879,769 | A | 4/1975 | Slawinski et al. | 4/7 |
| 4,181,985 | A | 1/1980 | Rius | 4/7 |
| 4,406,025 | A | 9/1983 | Huck et al. | 4/443 |
| 4,926,509 | A | 5/1990 | Bass | 4/448 |
| 4,953,238 | A | 9/1990 | Shifferly | 4/420 |
| 5,138,726 | A | 8/1992 | Campbell | 4/420 |
| 5,272,774 | A | 12/1993 | Ivko et al. | 4/420 |
| 5,384,919 | A | 1/1995 | Smith | 4/448 |
| 5,452,483 | A | 9/1995 | Dizon | 4/420.4 |
| 5,504,948 | A | 4/1996 | Chandler | 4/420.4 |
| 5,659,901 | A | 8/1997 | Derakhshan | 4/420.1 |
| 5,734,997 | A | 4/1998 | Raff | 4/420.2 |
| 5,813,060 | A | 9/1998 | Klopocinski | 4/351 |
| 5,911,516 | A | 6/1999 | Chang | 4/420.2 |
| 5,953,766 | A | 9/1999 | Szoke | 4/420.4 |
| 5,960,486 | A | 10/1999 | Huliganga | 4/447 |
| 6,000,070 | A | 12/1999 | Bonin | 4/349 |
| 6,105,179 | A | 8/2000 | Burns | 4/420.4 |
| 6,167,577 | B1 | 1/2001 | Hammad | 4/420.4 |
| 6,192,527 | B1 | 2/2001 | Paul | 4/420.4 |

*Primary Examiner*—Tuan Nguyen
(74) *Attorney, Agent, or Firm*—Gifford, Krass, Groh, Sprinkle, Anderson, Citkowski, P.C.

(57) ABSTRACT

A multi-function toilet seat having a body including an oval and arcuate shaped portion, defining an ergonomically configured upper surface and an open interior. A rear portion interconnects opposite extending ends of the arcuate shaped portion. A fluid inlet plug extends from a first location associated with the body and communicates with a plurality of succeeding and interior extending passageway channels. The channels communicate in turn with a plurality of spray nozzles located at spaced locations along an inner defining surface of the seat. A suction outlet extends from a second location associated with the body and communicates with an exhaust motor incorporated into the rear portion. A plurality of exhaust apertures extend along spaced inner locations of the seat and evacuate an airflow from within an associated toilet bowl interior and through the suction outlet.

20 Claims, 14 Drawing Sheets

FIG - 11
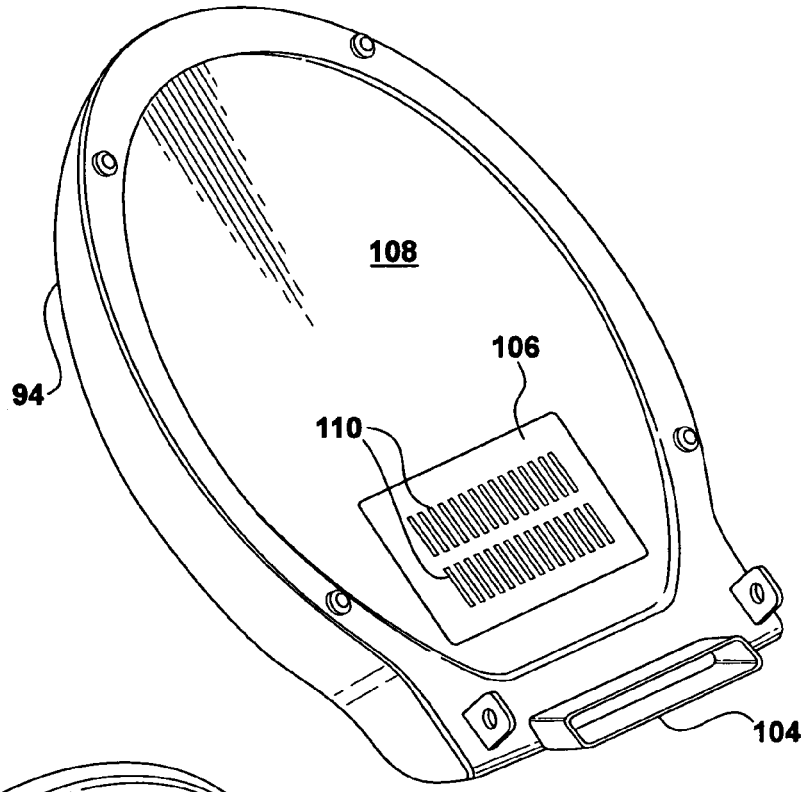
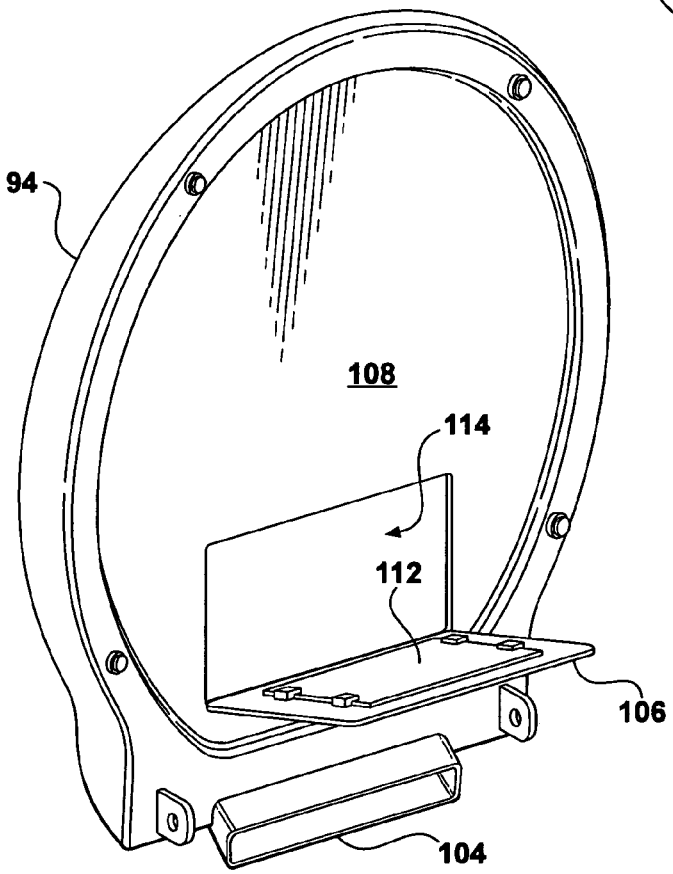
FIG - 12

FIG - 13
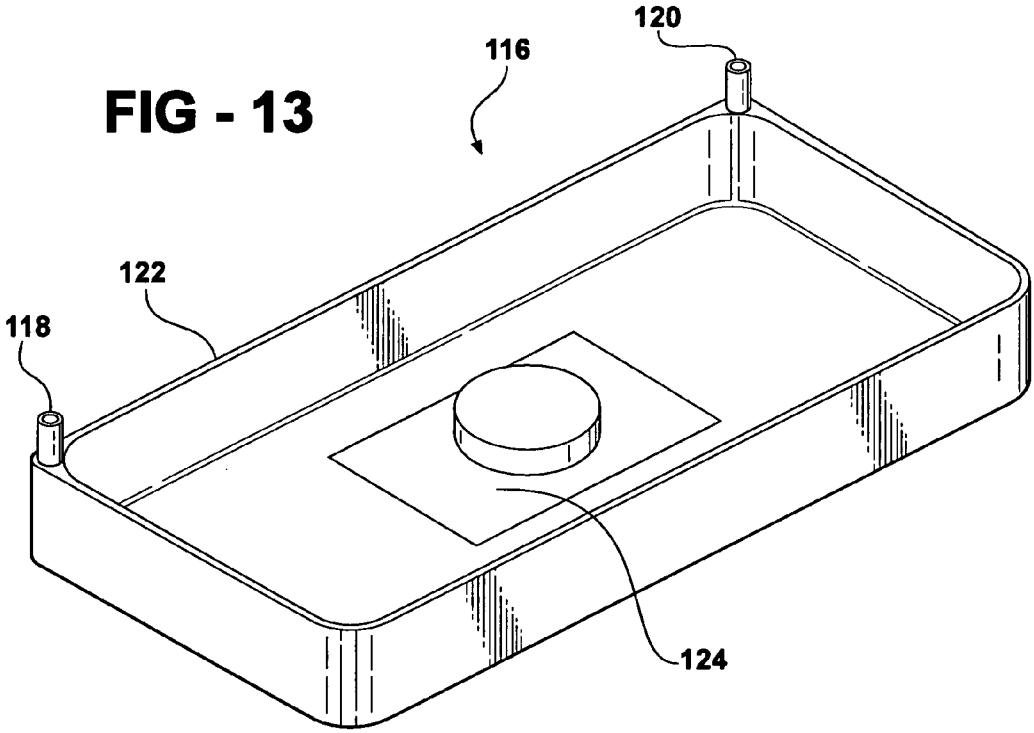
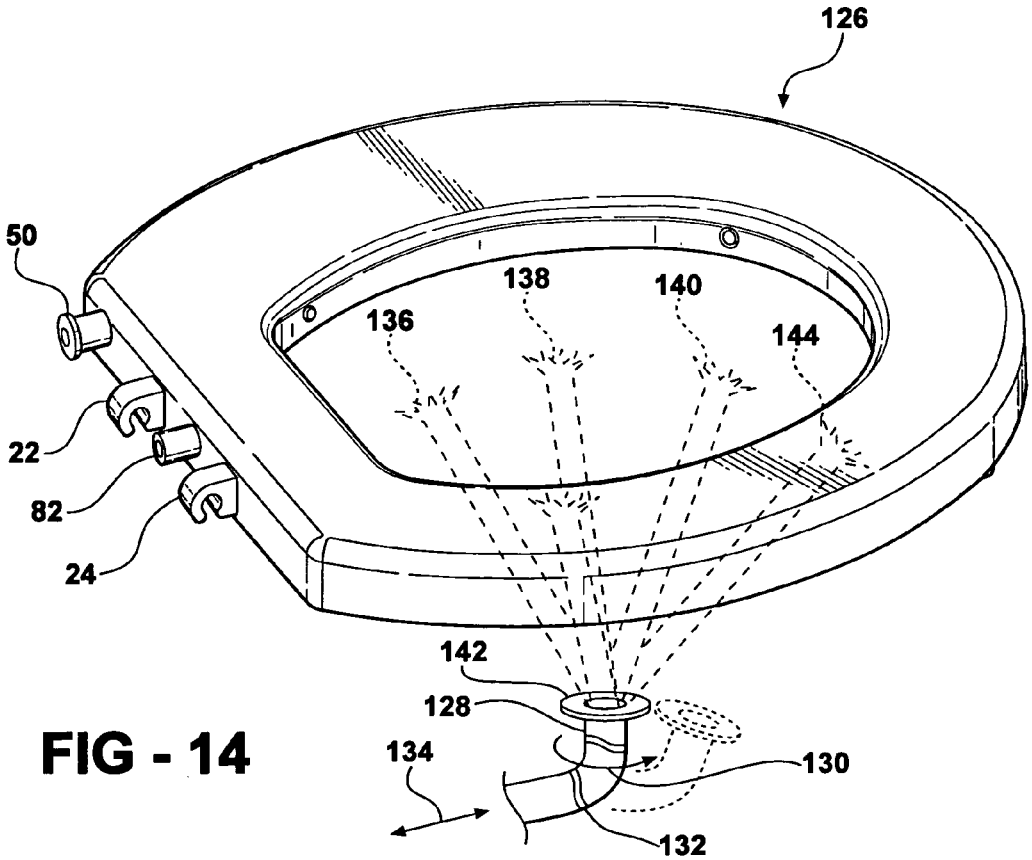
FIG - 14

SMART TOILET SEAT

CROSS REFERENCE TO RELATED APPLICATIONS

The present application claims the benefit of U.S. Provisional Patent Application Ser. No. 60/559,627, filed Apr. 5, 2004, and entitled "Smart Toilet Seat".

BACKGROUND OF THE INVENTION

1. Field of the Invention

The present invention is directed to a multi-purpose toilet seat and lid. In particular, the present invention discloses a novel and improved device combining the functions of ventilation, body washing (including hot/cold water and soap distribution), fragrance addition, and body drying incorporated into a self-contained unit.

2. Description of the Prior Art

A number of bidet-type personal hygiene devices are known in the art. In a known embodiment, the bidet operates as a stand-alone device separate from a conventional toilet. Conventional bidet functions include issuing a washing spray subsequent to a conventional toilet function, followed by a desired heating, odorizing or sanitizing function.

A further classification of prior art is concerned with portable or add-on bidet devices, such as which are installed into a conventional toilet. The advantage of such devices is that they provide many features associated with a conventional, stand-alone, bidet and without the added space, plumbing and installation requirements.

U.S. Pat. No. 6,167,577, issued to Hammad, teaches a personal hygiene bidet device which clamps to the side of the toilet bowl and connects to existing hot and cold water lines. A mixing valve is provided to adjust the temperature of the output water. A bracket fastens the bidet to the rim of the toilet bowl. A spray wand having a nozzle on its operative end functions to deliver water and soap to the genital area of an individual. A liquid soap dispenser is further provided to dispense soap from the bidet spray nozzle. The spray wand is retractable to the side of the toilet bowl when not in use.

U.S. Pat. No. 4,181,985, issued to Rius, teaches a spray attachment for connection to a conduit supplying water to a toilet bowl having a seat spaced above the bowl which includes a first valve controlling flow to the bowl and to a second valve from which extends a flexible tube passing under the toilet seat and having an upturned nozzle at its outward end centrally of the bowl. In a modification, the nozzle is connected to the tube by a swivel joint to bring the nozzle into and out of operating position in the toilet bowl.

U.S. Pat. No. 5,911,516, issued to Chang, teaches a bidet attachment for a toilet bowl and which includes a base plate for mounting on the upper horizontal rim surface of a toilet bowl, and a top cover mounted on the base plate. The bidet housing confines an opening for access into the toilet bowl. A heating element inside the bidet housing extends around a major part of the opening. A flexible water tube is sheathed on the heating element, and confines a water passage therewith. A water supply valve supplies water to the water passage. Water from the water passage is supplied to a nozzle assembly that is movable between retracted and extended positions. The heating element can be actuated for warming up the bidet housing and for heating water that flows through the water passage from the water supply valve and that flows out of the nozzle assembly.

U.S. Pat. No. 5,504,948, issued to Chandler, teaches a bidet attachment built into a toilet seat, the seat including a chamber opening to the sides of the seat. The bidet attachment includes a spray nozzle connected to a water supply via lines and valves. The nozzle rotates from a storage position within the chamber of the seat to a use position over the toilet bowl. The supply lines and valves are housed within the seat with the threaded water inlet connectors and flow control knobs extending exteriorly of the toilet seat.

U.S. Pat. No. 6,192,527, issued to Paul, discloses a water jet personal hygiene fixture for installation on a toilet bowl, comprising hot and cold water control valves to produce warm water from existing pipes in a bathroom. A pivotally-mounted nozzle produces a water jet, control handles further actuate the nozzle in a vertical arc and to control water pressure and flow, and also provided is a water shut-off valve. A base plate allows installation of the fixture on the toilet bowl in a space between the toilet bowl rim and the toilet seat, the seat having a cut-out to accommodate vertical travel of the nozzle. A novel hand towel is formed from a planar sheet of absorbent material into a tubular shape with a closed end as an aid for dab drying the user and the toilet seat area after the use of the fixture.

SUMMARY OF THE PRESENT INVENTION

The present invention is a multi-function toilet seat having a body including an oval and arcuate shaped portion, and defining an ergonomically configured upper surface and an open interior. A rear portion interconnects opposite extending ends of the arcuate shaped portion.

A fluid inlet plug extends from a first location associated with the body and communicates with a plurality of succeeding and interior extending passageway channels. The channels communicate in turn with a plurality of spray nozzles located at spaced locations along an inner defining surface of the seat.

A suction outlet extends from a second location associated with the body and communicates with an exhaust motor incorporated into the rear portion. A plurality of exhaust apertures extend along spaced inner locations of the seat and evacuate an airflow from within an associated toilet bowl interior and through the suction outlet.

Additional features include a first switch located at an exterior location of the seat for activating a pressurized water supply through the spray nozzles, a second switch activating the exhaust motor. The exhaust motor may include a two-directional switch to function as a drying motor for introducing a heated airflow through the rearward apertures.

At least one of a pressure-sensitive foot post extends from an underside location of the seat or a remote control for activating at least one of washing, odor evacuation, or drying stages associated with the seat. An access door is defined in a rear surface of a pivotally associated lid, a charcoal filter being supported against a surface of the access door and in proximity to the exhaust motor. In a further variant, a plurality of axially slidable supports extend from underside locations of the seat and for adapting to differently sized toilet bowl rims.

Yet additional features include a projecting and repositionable pipe associated with a recessed toilet bowl location and for redirecting a fluid spray in directions fore and aft relative to a user. An alternative to the odor exhaust mechanism produced according to the present invention includes alternate arrangements of the pressure activated switch and associated air relief valve.

It is also envisioned that a chemical filter element can be housed either in the toilet seat lid or within the seat itself. Finally, bottom projecting and pressure activating switches may also be configured to extend at circumferential locations about the underside of the toilet seat, these each including conically shaped elements which upwardly displace relative to the seat aperture to facilitate operation as an air pressure valve.

BRIEF DESCRIPTION OF THE DRAWINGS

Reference will now be made to the attached drawings, when read in combination with the following detailed description, wherein like reference numerals refer to like parts throughout the several views, and in which:

FIG. 11 is a second inverted perspective of the lid and illustrating the air withdrawal channel and underside access door for facilitating odor withdrawal, filtering and discharge;

FIG. 12 is a further perspective of the lid also shown in FIG. 11 and illustrating the access door open to reveal the charcoal filter and internally configured motor assembly;

FIG. 13 is an inverted view of a toilet tank cover, in use with a further preferred embodiment of the seat assembly, and illustrating the features of inlet and outlet tubes combined with the placement of a motor/pump assembly;

FIG. 14 is an illustration of an alternate washing mechanism incorporated into the toilet seat of the present invention and including a projecting and repositionable pipe associated with a recessed toilet bowl location;

DETAILED DESCRIPTION OF THE PREFERRED EMBODIMENTS

Figure 4:
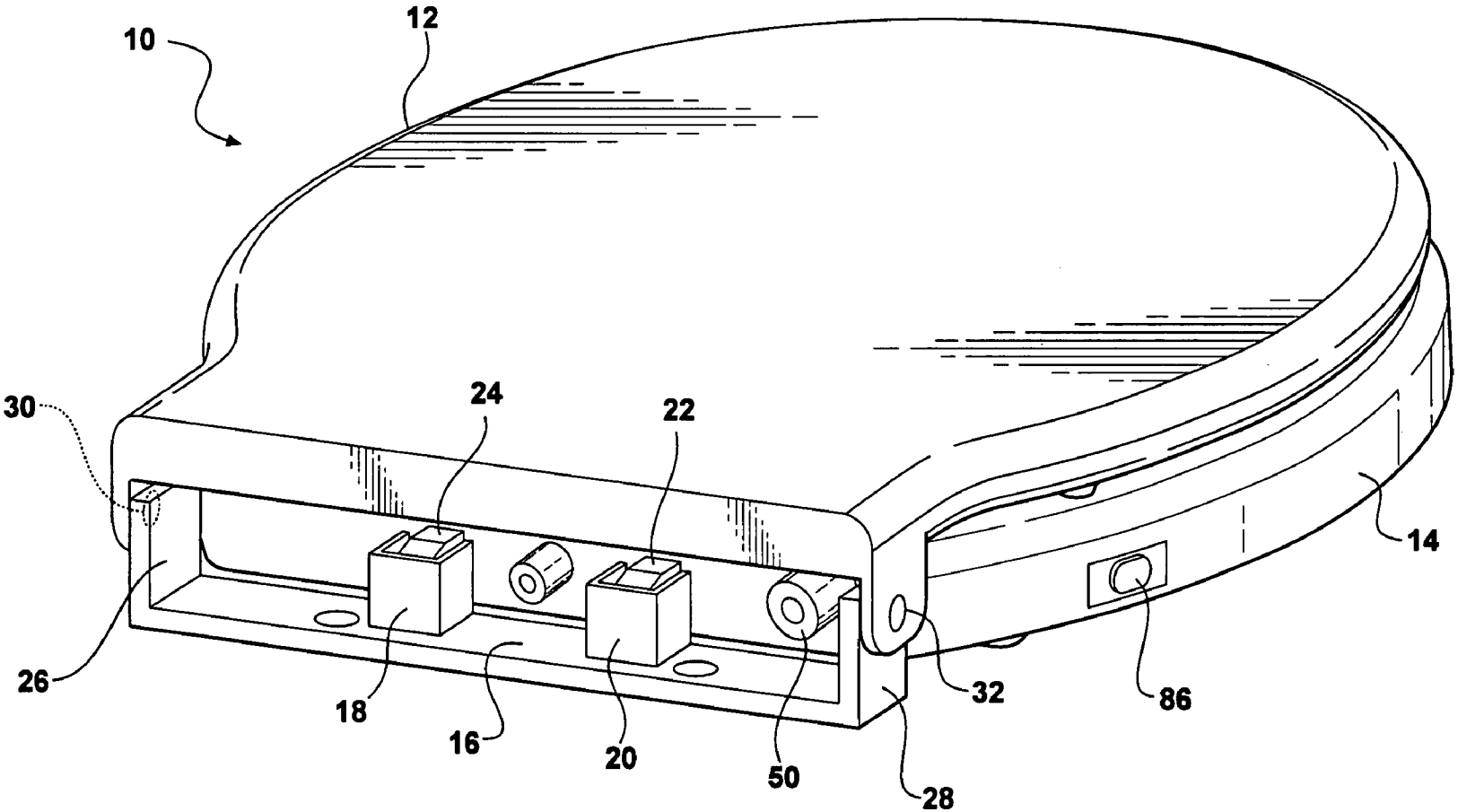
FIG. 4 is a rear elevational view of the combined seat and lid and further illustrating the mounting bracket for facilitating securing the assembly to an existing toilet.
Figure 5:
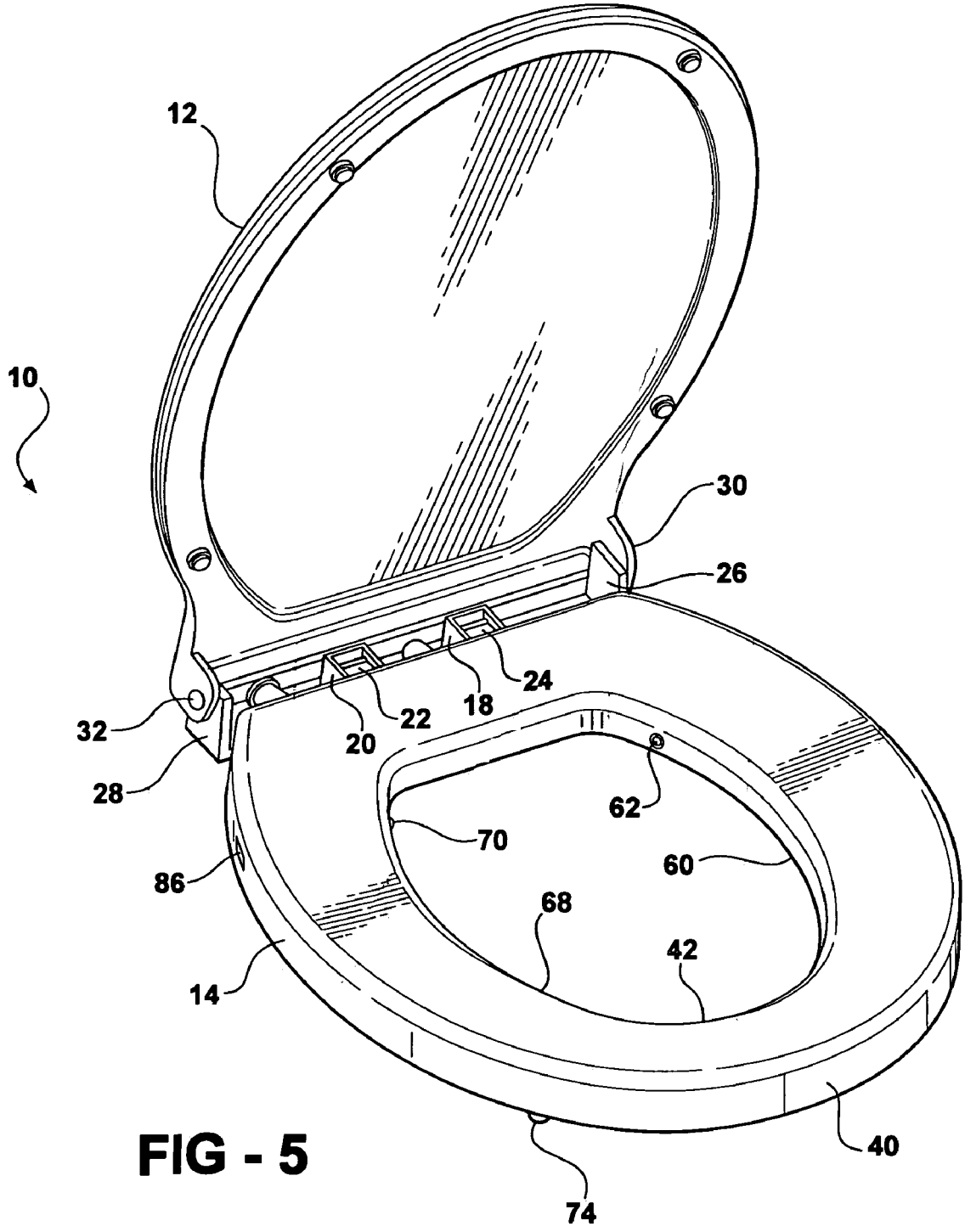
FIG. 5 is a succeeding perspective view showing the lid pivotally engaged relative to the seat.
Figure 6:
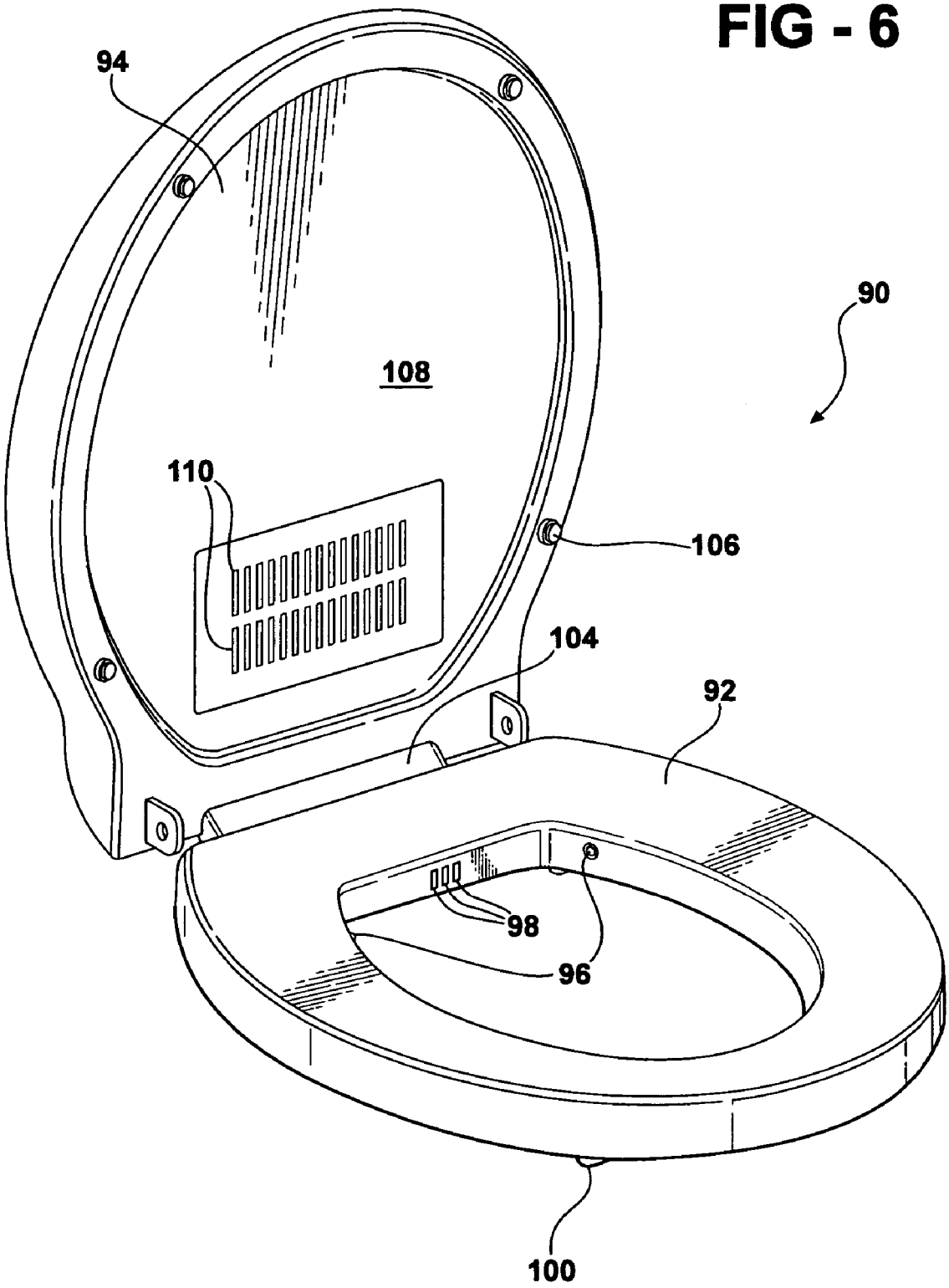
FIG. 6 is perspective view of a toilet seat and lid according to a second preferred embodiment of the present invention.
Figure 7:
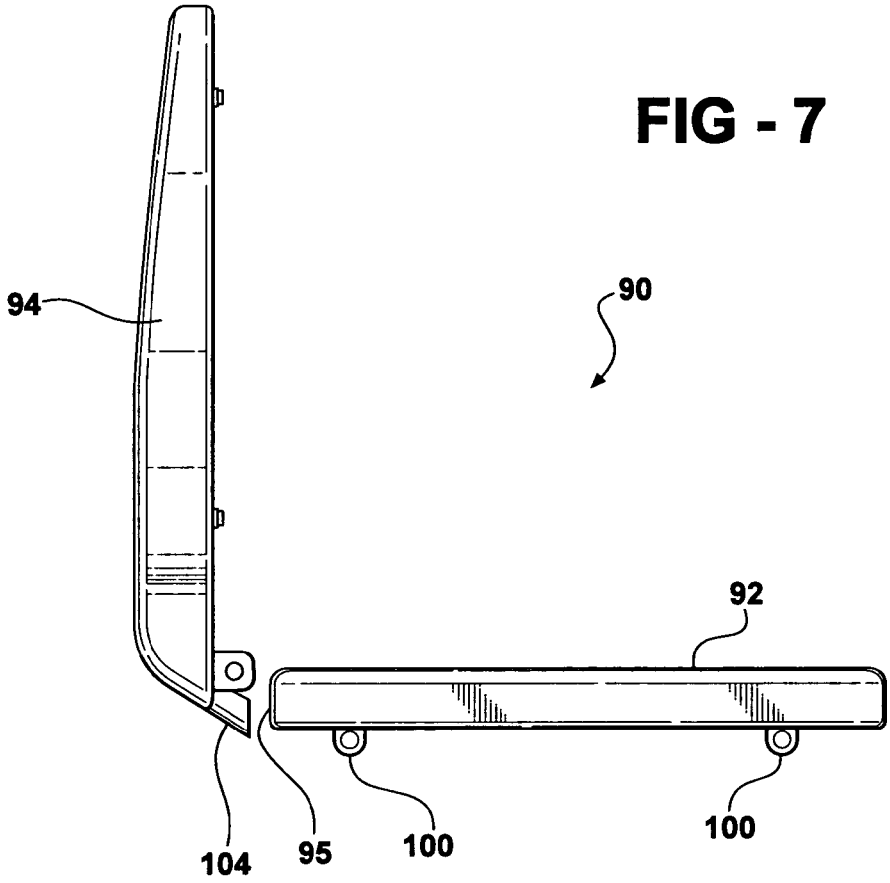
FIG. 7 is a side assembly view of the seat and lid shown in FIG. 6.
Figure 8:
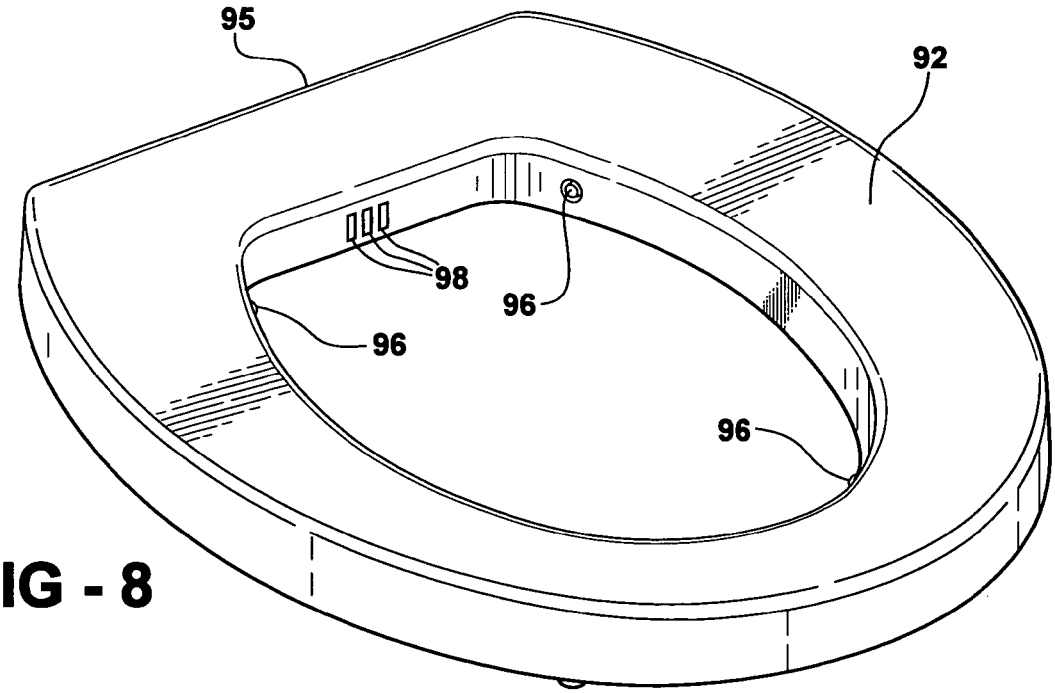
FIG. 8 is a first perspective of the seat according to the embodiment of FIG. 6.

Referring to FIGS. 4 and 5, a multi-purpose toilet seat and lid configuration is shown at 10 according to the present invention and which includes a lid portion 12 pivotally secured to a seat 14 by virtue of an inter-disposed bracket 16. As best shown in FIG. 4, the bracket 16 includes supports 18 and 20 for pivotally engaging, respectively, hinges 22 and 24 associated with a rearward edge of the seat 14. Angled end portions 26 and 28 of the bracket 16 are further pivotally engaged by downwardly configured tabs 30 and 32 associated with the lid 12.

Referring again to each of FIGS. 1–5, each of the toilet seat 14 and lid 12 are constructed of a durable plastic material or other suitable budget or recycled material. In particular, the seat and lid may be constructed of a sanitary or hygienic plastic material.

Figure 1:
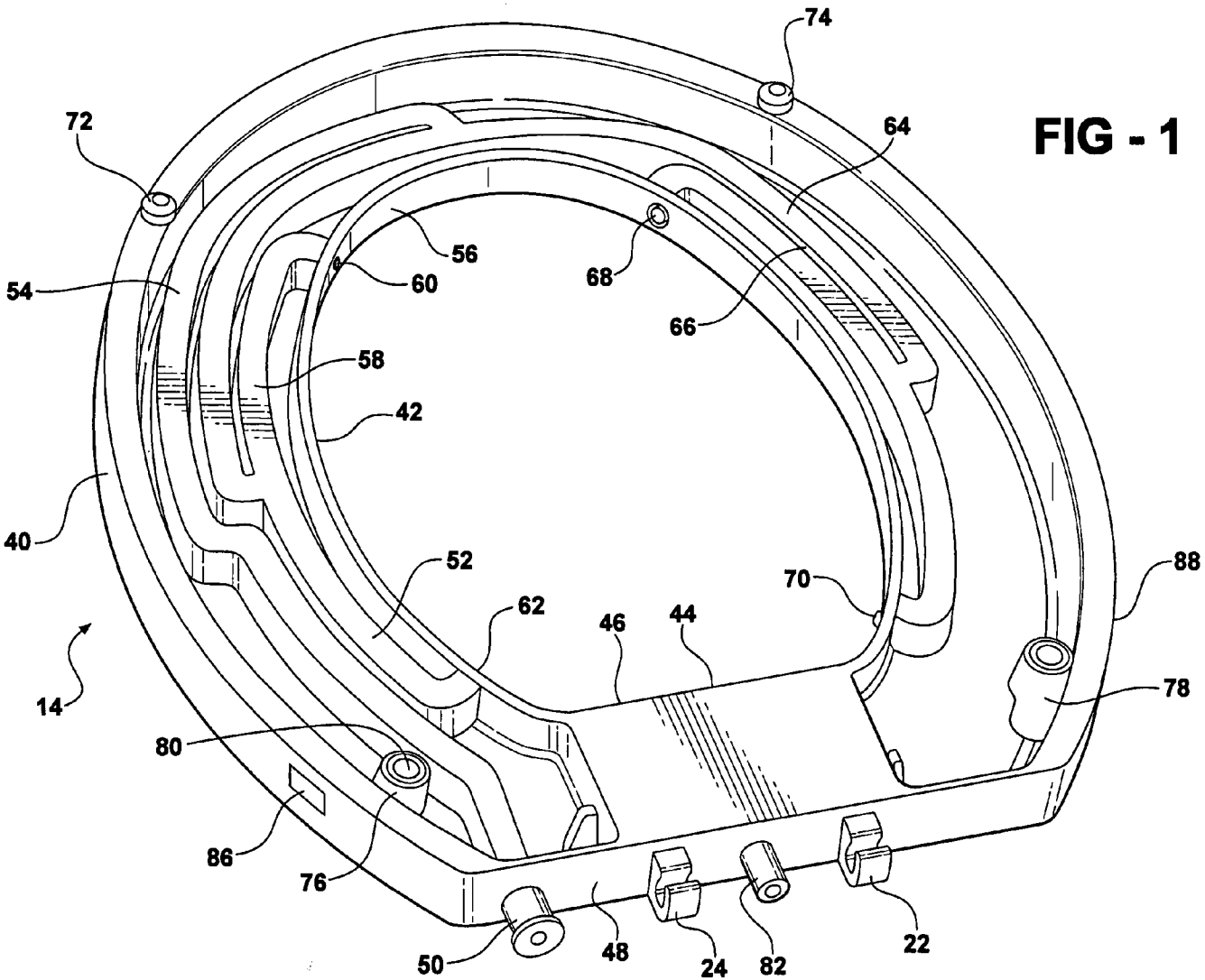
FIG. 1 is an underside perspective view of the toilet seat according to a preferred embodiment of the present invention and which illustrates the water and air passageways, associated inlet and outlet locations and activation switches.
Figure 2:
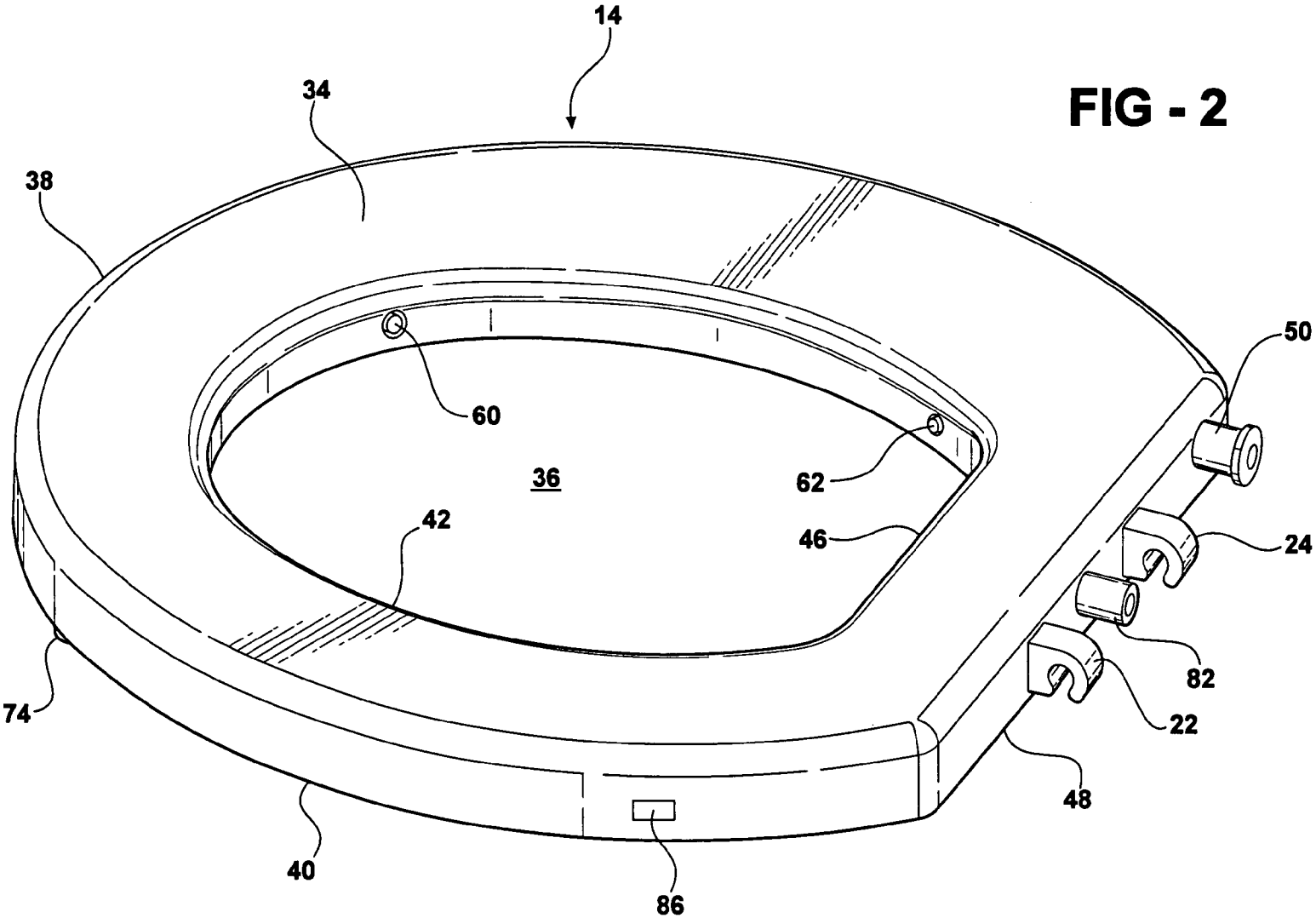
FIG. 2 is a rotated top-side perspective view of the toilet seat of FIG. 1 and illustrating in additional detail the features of the inwardly/upwardly directed spray nozzles, water/air dry activation switches, and water/air inlet and suction outlet components.

Referring to FIGS. 1 and 2, the seat 14 includes a smooth upper surface and a bottom configured surface. Viewing first FIG. 2, upper oval surface is illustrated at 34 and exhibits a sufficiently large and widened surface for receiving and supporting the body of larger sized individuals. The seat also includes a sufficiently small central opening (see at 36) to permit receiving smaller sized individuals.

The upward surface 34 is further shaped in an ergonomically sound and anatomically correct manner to fit the configuration of the contacting human buttocks and upper rear legs. In particular, this is achieved by designing the upward surface of the seat in a manner to avoid excessive pressure on the user's sciatic and/or popliteal nerves, arteries and veins. In this fashion, direct pressure on these vital structures is avoided or minimized, thus reducing the likelihood of leg pain and/or numbness during the period of use of the toilet.

The outer layer of the upward surface, see further at 38 in FIG. 2, contains coarse and pressure-relieving grooves in order to minimize the airtight contact with the human body, thus minimizing the downward pressure on vital structures of the thigh. The outer layer 38 is further coarsely texturized to further minimize the airtight contact with the human body, thus further minimizing the downward pressure applied to vital structures of the human thigh. Further, the outer several inches of the circumference of the upwardly surface are constructed to be at a higher level than the inside parts of the same upward surface.

In sum, the different levels of topography associated with the upward surface 34 of the seat 14 exist for one primary purpose, that being to avoid or reduce the pressure exerted upon the most medially located nerves and blood vessels of the thighs and legs during seating to use the toilet. In this fashion, annoying pressure on the nerves or blood vessels of the lower limbs is reduced or avoided entirely, thus avoiding the numbness or temporary discomfort associated with sciatic pain and hyperesthesia (tingling in the feet and/or legs) and which are common experiences of toilet users.

Referring further to FIG. 2, a perspective view of the toilet seat 14 is shown and which includes an outer arcuate rim 40, a spaced apart inner arcuate rim 42, and a rear portion 44. The rear portion 44 houses an air chamber, as will be further described, and defines an inner surface 46 adjoining at opposite edges with the inner arcuate rim 42 and an outer surface 48 from which project the hinges 22 and 24.

As is best shown in FIG. 1, the perspective underside view of the toilet seat 14 exhibits a number of passageways extending along its arcuate and oval length. Specifically, a water supply conduit (not shown) is communicated to a water/air inlet plug 50 extending from the rearward outer surface 48 of the rear portion 44.

A series of interconnecting and arcuate extending enclosed conduit portions extend from the inlet plug 50, these including first and second interconnecting and extending conduit portions 52 and 54. A succeeding conduit portion 56 branches from an end of conduit portion 54 and in turn feeds into an intermediate location of a succeeding conduit portion 58 which in turn communicates to nozzles 60 and 62 located at spaced apart locations along the inner rim 42. An extension 64 of the conduit portion 56 feeds into the opposing arcuate side of the seat 14 and communicates to a succeeding conduit portion 66, which feeds an additional and opposingly arrayed pair of nozzles 68 and 70. As will be further described in more detail with a discussion of the embodiment of FIGS. 7–12, it is understood that the passageways illustrated in the embodiment of FIGS. 1–5 are but one possible arrangement for the toilet seat.

In use, the inlet plug 50 and interconnecting passageways provide for conduit of a mixture of hot and/or cold water for dispersion through the spray nozzles 60, 62, 68 and 70. The nozzles may further distribute fluid in a multi-jet fashion about the inner circumference of the seat and in a preferably slightly upwardly directed fashion in order to impact upon the lower extremities of the user. Additionally, the warm water circulating the inside of the seat cavity will result in warming the temperature of the seat, thus providing added comfort to the user.

Although not shown, the conduit connection to the seat 14 includes a pair of water connection inlets, one for cold water and the other for hot. The inlets are designed to exhibit conventionally sized bearing threads which are designed to fit ordinary hose or plumbing pipes. The hot and cold water will admix within a most rearwardly positioned mixing chamber located in the seat cavity. The mixing chamber includes two inlets, one for each water line, and connects with the main cavity through a control valve referred to as inlet valve A. A thermal valve can replace the mixing chamber where the cold and hot water volumes will mix outside the TSBC cavity, and before entering the TSBC cavity.

A thermal valve mixer has the advantage of better control on the temperature of the water delivered to the cavity of the seat using only one zone valve to control both cold and hot water. A gate valve (i.e., water supply valve) may be conveniently situated for access by a user's hands and to control the flow of the premixed, temperature-controlled water, into the cavity of the seat. The thermal valve has the function of preventing the incidence of burns from water that is too hot, and by delivering the water at a constant and consistent temperature.

Although not clearly shown, it is understood that the floor of the seat cavity slopes in a slightly downward direction and towards the front edge in order to facilitate drainage of excess or leftover water either before or after completion of the washing process. Further, the spray outlets or nozzles 60, 62, 68 and 70 are all preferably arranged in equidistant spaced location about the inner rim 42, their diameter of opening, outlet stems, and number of terminal holes translating into a strong and adequate stream of water spray.

Additional features of the seat configuration include the spacing of the inner 42 and outer 40 arcuate walls, in combination with the underside shaping of the seat and in order to fit differently shaped and sized toilet bowl rims. Foot posts 72 and 74 are located at spaced locations along the front of the seat underside, and additional posts 76 and 78 are located at corresponding rear corners.

Figure 3:
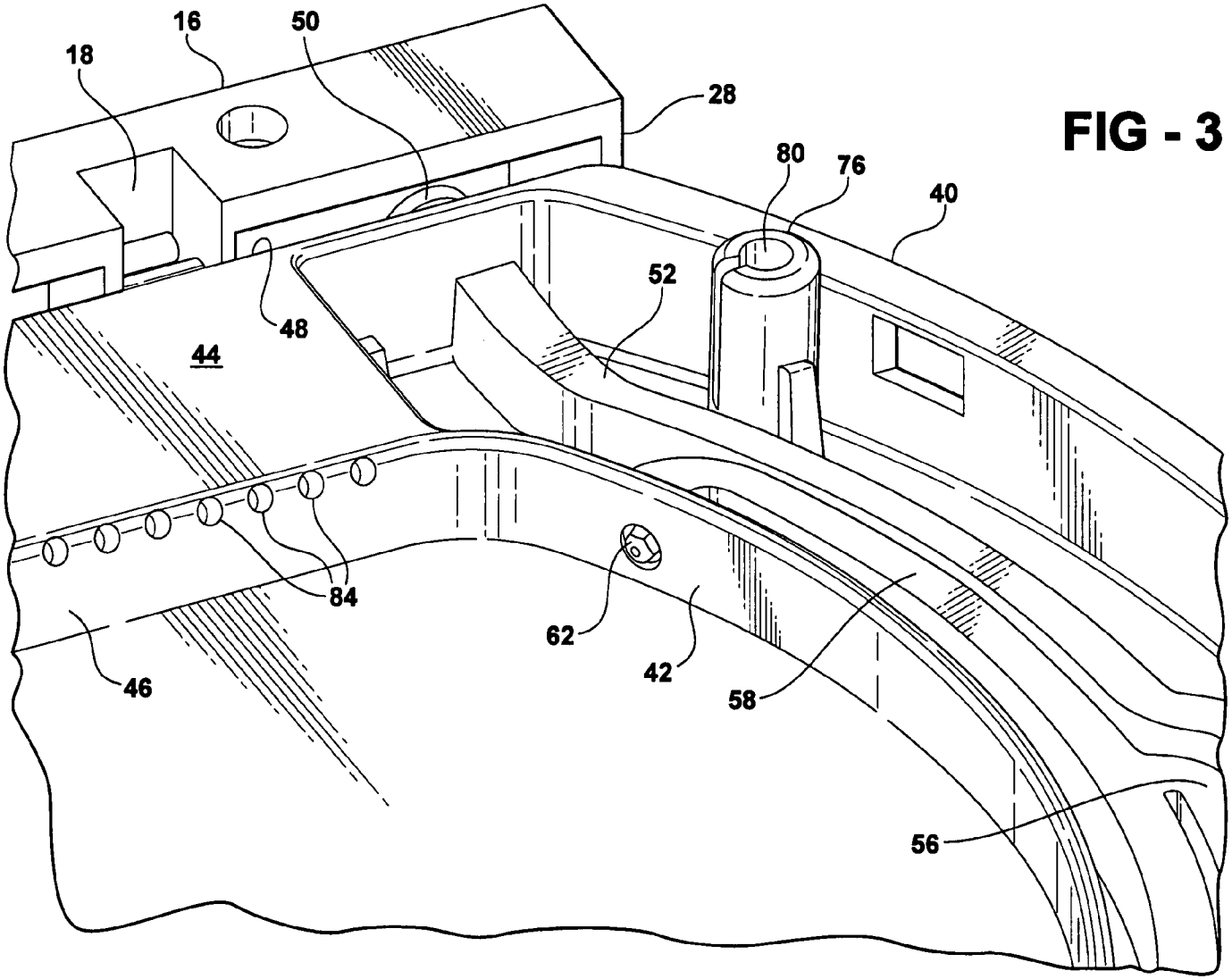
FIG. 3 is an enlarged underside sectional detail of the toilet seat and illustrating in additional detail the features of the air chamber nozzles extending along a rear inner surface, as well as the pressure sensitive sensor for responding to the applied weight of a user to activate selected functions of the device.

Referring to the enlarged underside view of FIG. 3, a pressure sensitive switch is illustrated at 80 located in extending fashion from the rear support post 76. The function of the pressure sensitive switch is to activate one or more functions of the seat device (such as again the washing, air-drying, fragrancing, etc., functions) upon the user applying downward pressure, such as again by sitting upon the upper surface 34 of the seat 14.

Also extending from the rearward surface 48 of the seat 14 is a suction outlet 82 operating in cooperation with an exhaust motor (not shown) which is incorporated into the rear portion 44 of the seat. A plurality of exhaust nozzles 84 are located along the rearward and inner facing surface 46 of the rear portions and, in combination with the exhaust motor and associated inner conduit passageway, evacuate a stream of air (and associated noxious fumes) to the suction outlet 82, and through an exhaust line (not shown) connected to the outlet 82 to be vented at a remote location, typically outdoors.

Also shown at opposite exterior locations of the seat are a first switch 86 (FIG. 1) for activating/deactivating the water flow functions, whereas a second switch 88 operates the air drying capacities associated with the rear portion 44. The pressure switch 80 associated with rearward post 76 can, optionally, also activate the exhaust motor upon seating by the user.

Additional features may include submerging the exhaust vent in the depth layers of the water in the toilet tank. The tank may also contain an oxidizing element such as chlorine granules to render the water an oxidizing power against the odorous gases to be vented. Oxidizing these gases will result in rendering them odorless and water soluble, and consequently flushed out when the toilet is flushed. It is also envisioned that special rubber gaskets, adaptors or spacers may be used to lift up the tank cover in order to allow the vent tubing into the tank. The exhaust vent connects into a chemical filter which contains charcoal or other odor-absorbing chemicals. Yet additional features include constructing the exhaust motor of a waterproof material, providing the motor electric circuit via a GFI circuit breaker, providing all electrical wiring of the motor inside a waterproof conduit and optionally providing a battery-operated motor instead of electric powered motors.

An operational protocol associated with the invention includes the steps of lifting the toilet seat lid to the full open and upwardly pivoted position (see FIG. 5). The user then sits upon the toilet seat activating the exhaust through a pressure sensitive switch mounted at a bottom of the seat. The user then exercises the necessary bodily function such as a bowel movement, and proceeds to flush the toilet.

At this point, the user opens (either manually or by motor control) the thermal mixing water gate valve. After washing, the user turns off the water and activates a switch to reverse the airflow direction of the exhaust motor to a drying mode. Along these lines, it is envisioned that the exhaust motor be provided with two-way capabilities to introduce a heated air stream through the rear nozzles and in order to assist in the drying function and it is again understood that all of the above steps are either accomplished manually or by switch/remote control.

Additional features capable of being used with the seat and lid device include liquid soap dispensing, such as during the personal washing stage, and a fragrance solution dispensing used before, during and after use of the toilet. The seat and lid arrangement of the present invention provides features beyond those found in a standard bidet, and without the mess of the standard bidet water spray supply and the added cost of a separate bidet.

Other features include eliminating the need for toilet paper, which is considered unhygienic and which provides incomplete cleanliness. The one-piece construction of the present device eliminates the need for extraneous nozzles or control panels and associated contamination. The present device is further capable of performing several functions simultaneously and without the requirement of added attachments. Also, the present invention is intended to enhance and ease postoperative care for rectal, perineal and vaginal cases. Yet additional advantages include providing a hydromassaging function to assist in alleviating pain and improving the circulation in the recto-perineal and vaginal areas.

Referring now to FIGS. 6–12, a combined toilet seat and lid arrangement is illustrated at 90 according to a further preferred embodiment of the present invention. The arrangement 90 includes a seat 92 and a pivotally attachable lid 94, the respective features of which will now be described.

Referring collectively to FIGS. 6–9, a number of illustrations of the seat 92 are shown and which include, in contrast to the configuration of FIGS. 1–5, a fully enclosed and internally hollowed body. As with the seat 14 in the first preferred embodiment, a fluid inlet plug is associated with a selected location (such as again along a rear edge wall 95) of the seat 92 and in order to communicate fluid with the ring shaped and hollowed interior of the seat for discharge through interiorly disposed nozzles 96. Although not clearly shown, it is also understood that an air discharge passageway is communicated with the rear edge surface 95 and which interconnects with such as slots 98 defined along an inner rear portion of the seat 92.

The seat 92 is in contrast to the arrangement best illustrated in FIG. 1, and by which the seat 14 in that embodiment includes the plurality of individual and interconnecting passageways. In the present embodiment, the seat 92 is fully enclosed and such that the substantially the entire open interior is capable of storing and issuing a stream of cleaning water, with the same advantages of providing ambient warming to the underside of the user.

Figure 9:
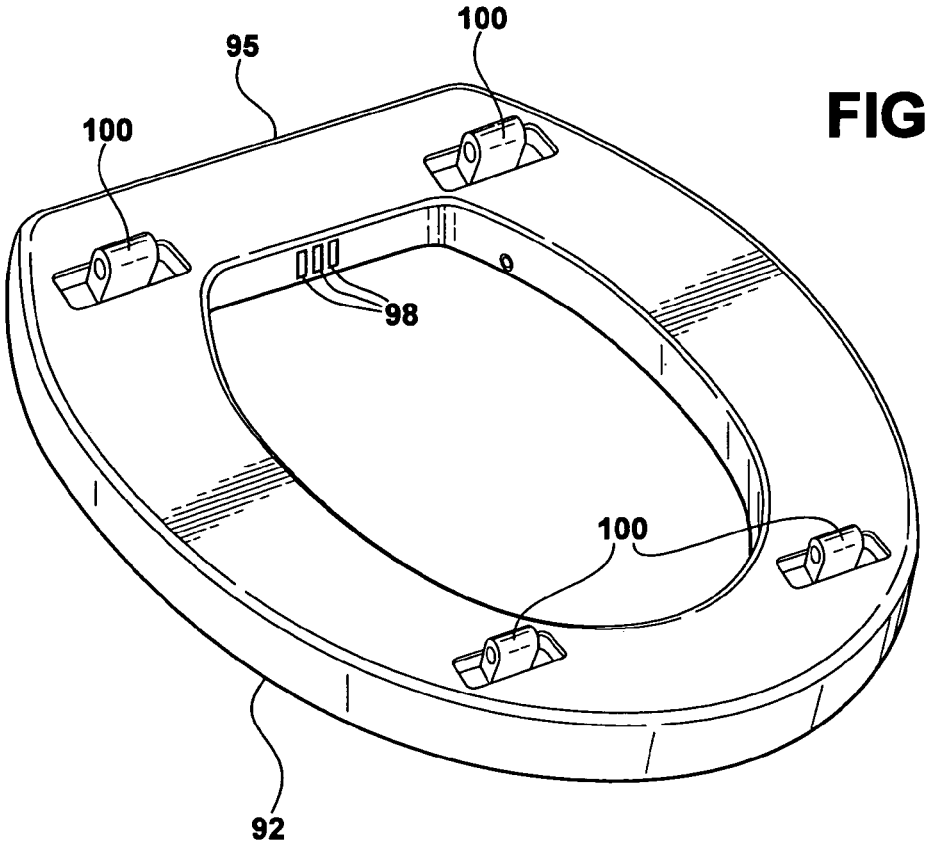
FIG. 9 is a second inverted perspective of the seat and illustrating axially slidable supports for adapting to differently sized toilet bowl rims.

Referring again to the underside perspective of FIG. 9, a set of four short, medium, or long sized separately attached and fixed supports are illustrated at 100 for adapting to differently sized toilet bowl rims.

Figure 10:
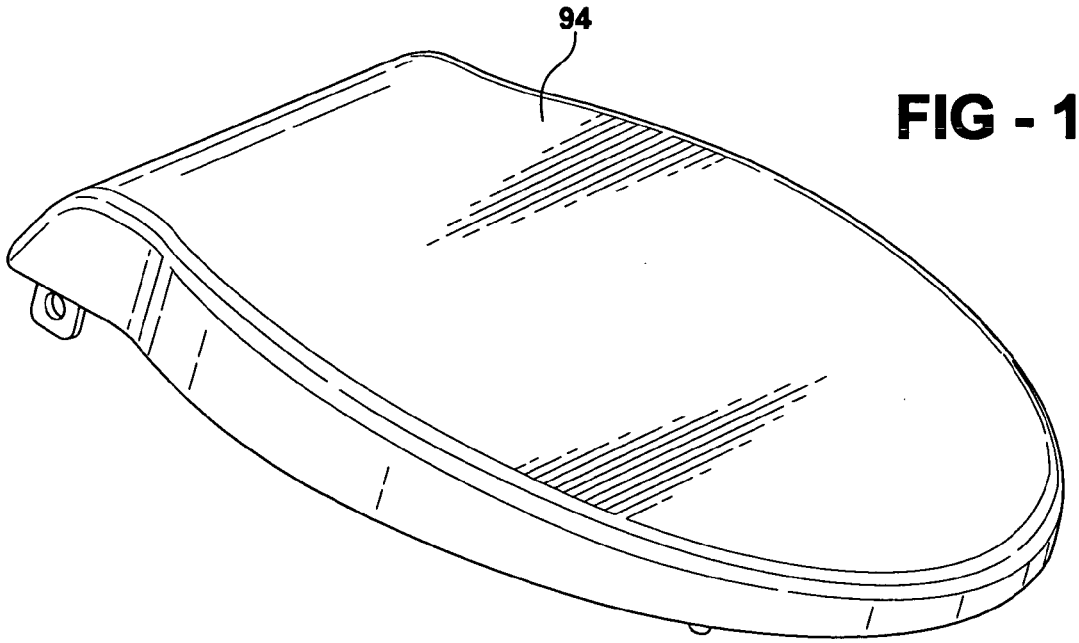
FIG. 10 is a first perspective of the lid according to the embodiment of FIG. 6.

Referring further to FIGS. 10–12, a series of perspective view of the rotatably engageable lid 94 are shown and which, upon being pivotally secured to the rear 95 of the seat 92, communicates a projecting (angularly as illustrated) air channel 104 from the lid 94 to or just loosely attached under or in alignment with the associated air passageway formed within the rear edge surface 95 of the seat 92. An access door 106 is pivotally secured to an underside surface 108 of the lid 94 and includes a plurality of vents 110 in communication with the slots 98 and projecting air channel 104. As best shown in FIG. 12, a rectangular shaped charcoal filter 112 is supported upon an inner surface of the access door 106 and a motor assembly 114 is contained within the body of the lid 94 for activating the vacuum assembly and for discharging the filtered air through the access door vents 110.

Referring to FIG. 13, an inverted view of a toilet tank cover is shown at 116, in use with a further preferred embodiment of the seat assembly. In particular, the tank lid 116 illustrates the features of inlet 118 and outlet 120 tubes, combined with the placement of a motor/pump assembly 122 upon an underside surface of the tank lid 124. In this embodiment, the features of the air evacuation pump are removed from the lid and repositioned within the tank. Appropriate conduit connections are established for withdrawing the exhaust air from the bowl and delivering by a tube positioned in the tank and submerged beneath the water level, and in order to remove the odors.

Referring now to FIG. 14, an illustration is shown at 126 of an alternate washing mechanism incorporated into the toilet seat of the present invention and including a projecting and repositionable pipe 128 associated with a recessed toilet bowl location (not shown). The pipe 128 is rotatably adjustable (see arrow 130) about a pivot 132 incorporated into the pipe wall structure.

In a preferred application, the pipe 128 is constructed of a solid plastic or rust-proof metal and which is also extendable or retractable (see arrow 134) relative to a specially configured wall location associated with the toilet bowl and in directions both telescopically as well as pivotally. A plurality of adjustable spray patterns, 136, 138, and 140 are illustrated in progressively rear to front directions over a range associated with the open interior of the toilet seat. An initial rest position is illustrated at 142 and an alternate rest position at 144.

Figure 15:
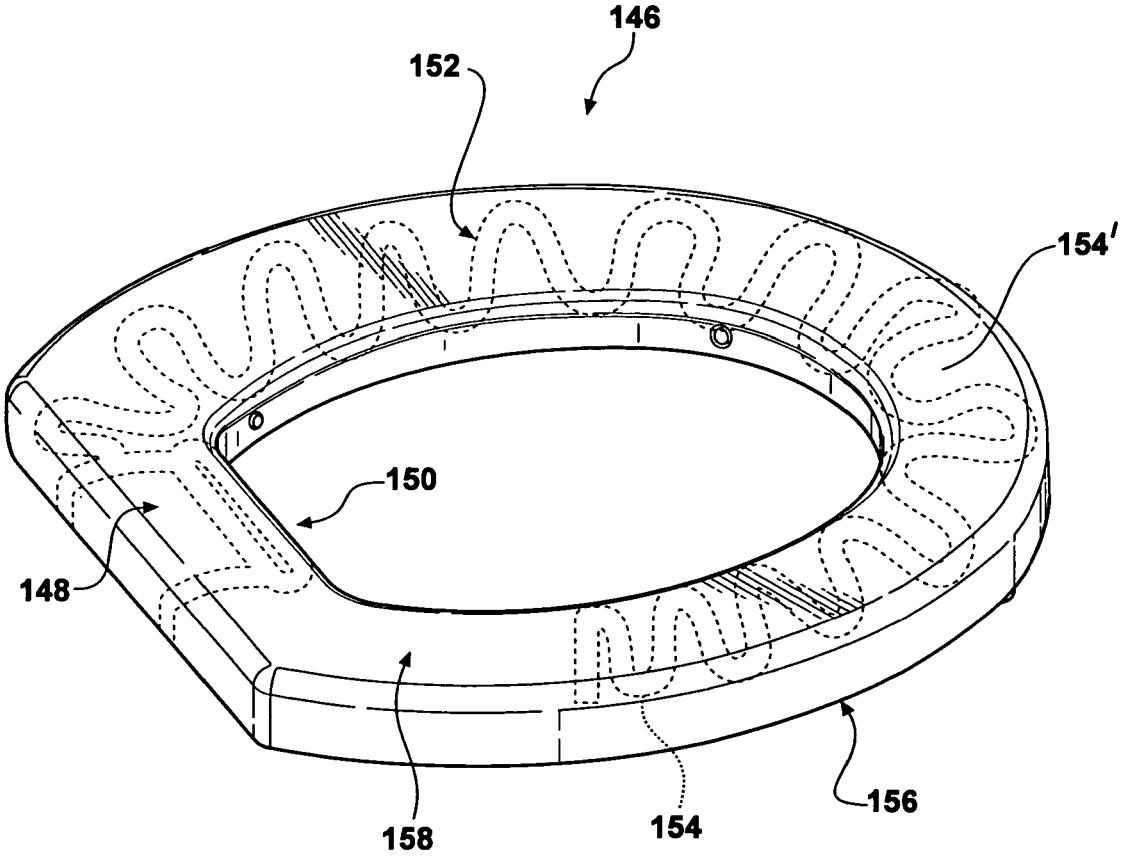
FIG. 15 is an illustration of a further odor exhaust mechanism produced according to the present invention and in particular illustrating an alternate arrangement of pressure activated switch and associated air relief valve.

Referring now to FIG. 15, an illustration is shown at 146 of a further odor exhaust mechanism produced according to the present invention. In particular, FIG. 15 illustrates an alternate arrangement of pressure activated switch and associated air relief valve.

The odor exhaust mechanism includes a housing compartment 148 for the associated electric motor (not shown). An exhaust inlet is located at 150 and a charcoal compartment at 152. A charcoal compartment is shown extending over positions 154 and 154', and an air relief valve is located at a substantially 8 o'clock position, see at 156, and which extends from an underside direction of the seat. The charcoal may be formed in loopwise or undulating fashion, it being envisioned that air is passed through in order to purify and scent. It is also understood that the charcoal can be reconfigured in any manner to allow for maximum surface area contact with the odorous air. It is also envisioned that any other solid or liquid odor-neutralizing chemical can also be used, such as a liquid chlorine or the like. A water compartment is generally located at position 158 in FIG. 15.

Figure 16:
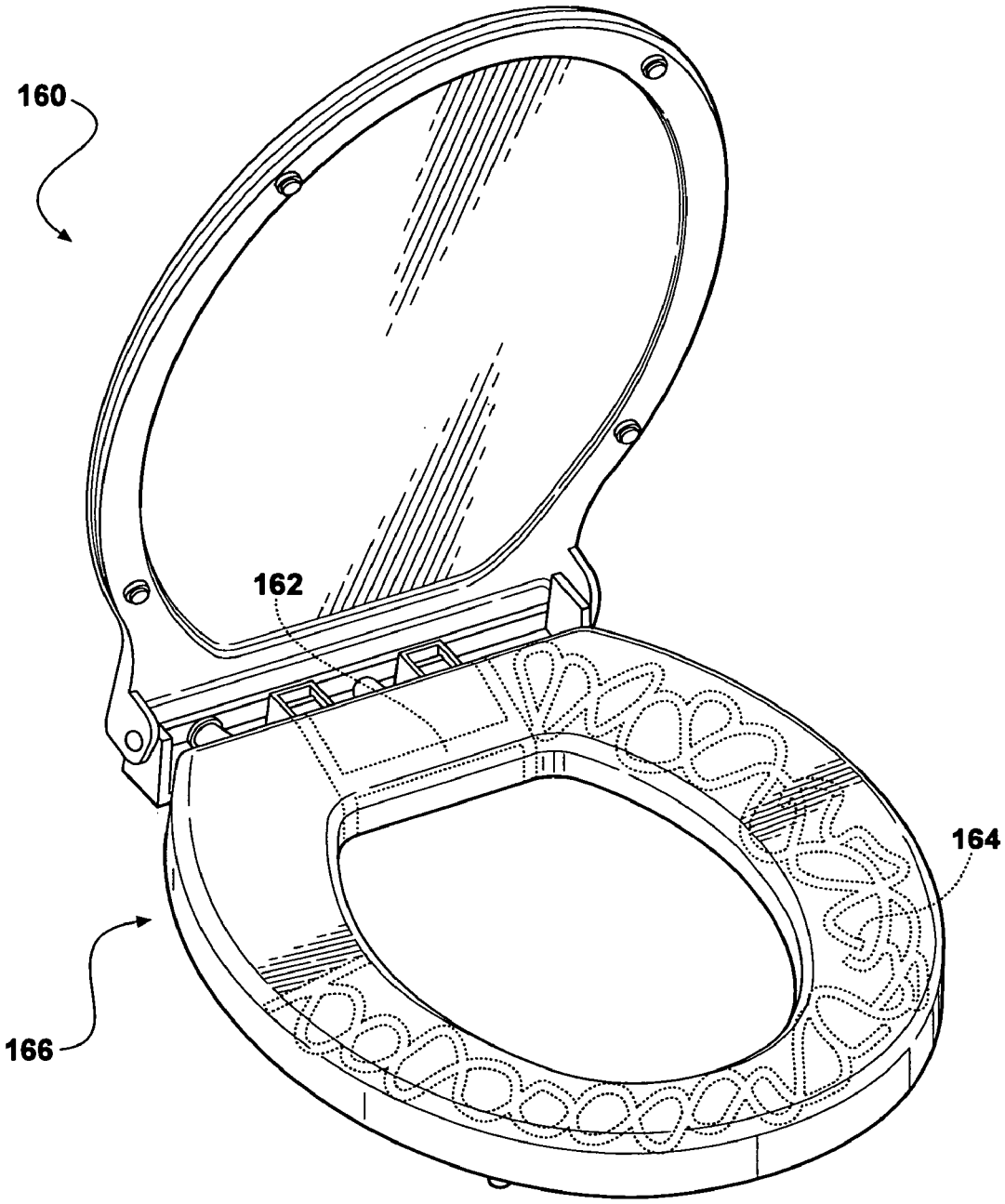
FIG. 16 is a rotated perspective of the illustration substantially shown in FIG. 15 and further illustrating a chemical filter element housed either in the toilet seat lid or within the seat itself.

FIG. 16, see as generally illustrated at 160, discloses a rotated perspective of the illustration substantially shown in FIG. 15, and further illustrating a chemical filter element housed either in the toilet seat lid or within the seat itself. In particular, illustrated at 162 is a flat sheet located at the entrance of the exhaust inlet. Alternatively, the chemical filter element can be housed within the body of the seat, see as shown at 164. Further illustrated at 166 is a water compartment associated with the seat and for storing a ready supply of fluid in an alternate embodiment.

Figure 17:
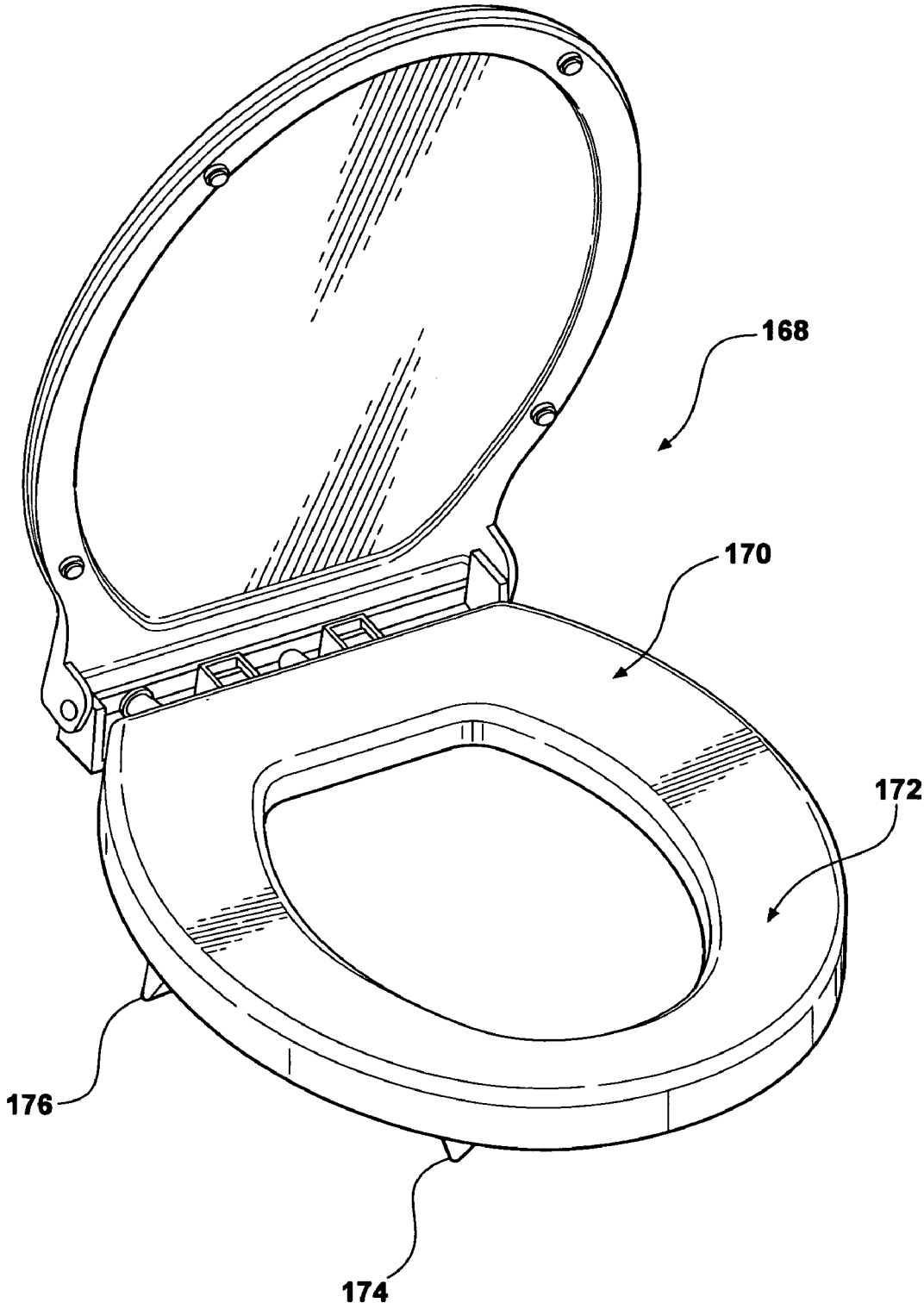
FIG. 17 is a further perspective view of the toilet seat and lid according to the present invention and illustrating bottom projecting and pressure activating switches extending at circumferential locations about the underside of the toilet seat.

Referring now to FIG. 17, a further perspective is shown at 168 of the toilet seat and lid according to a still further variant of the present invention and illustrating bottom projecting and pressure activating switches extending at circumferential locations, see at 170, 172, 174 and 176 about the underside of the toilet seat. These correspond, respectively, to generally 2 o'clock, 5 o'clock, 8 o'clock and 10 o'clock positions about the annular toilet bowl rim.

Figure 18A:
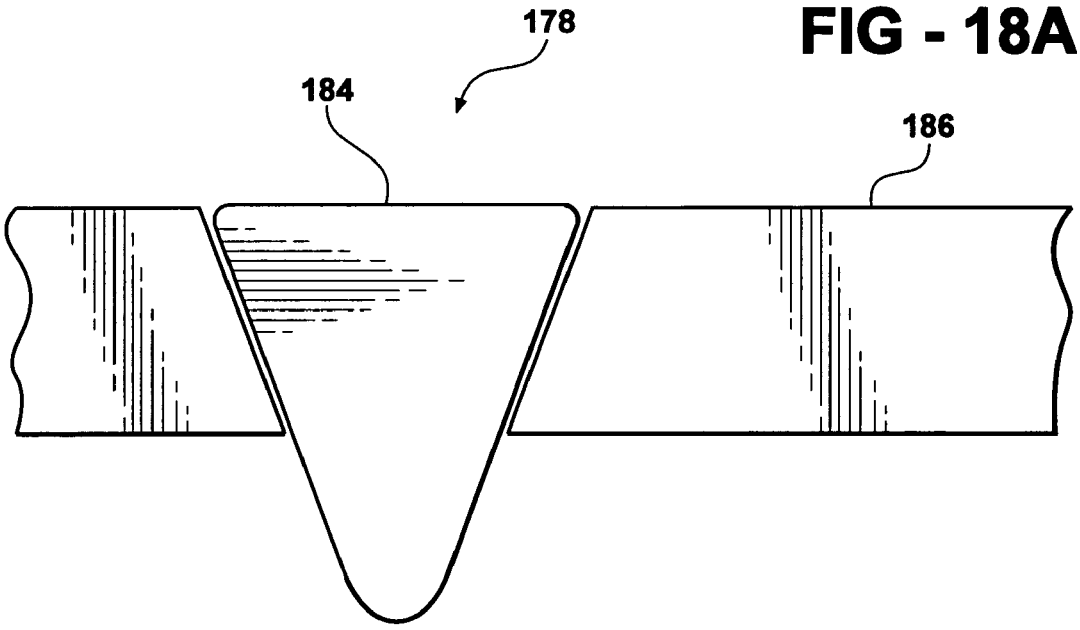
FIGS. 18A and 18B illustrate, respectively, pre and post actuating positions associated with a selected and downwardly extending pressure switch, and in particular illustrating the manner in which upward displacement of the conical shaped element relative to the seat aperture facilitates operation as an air pressure valve.
Figure 18B:
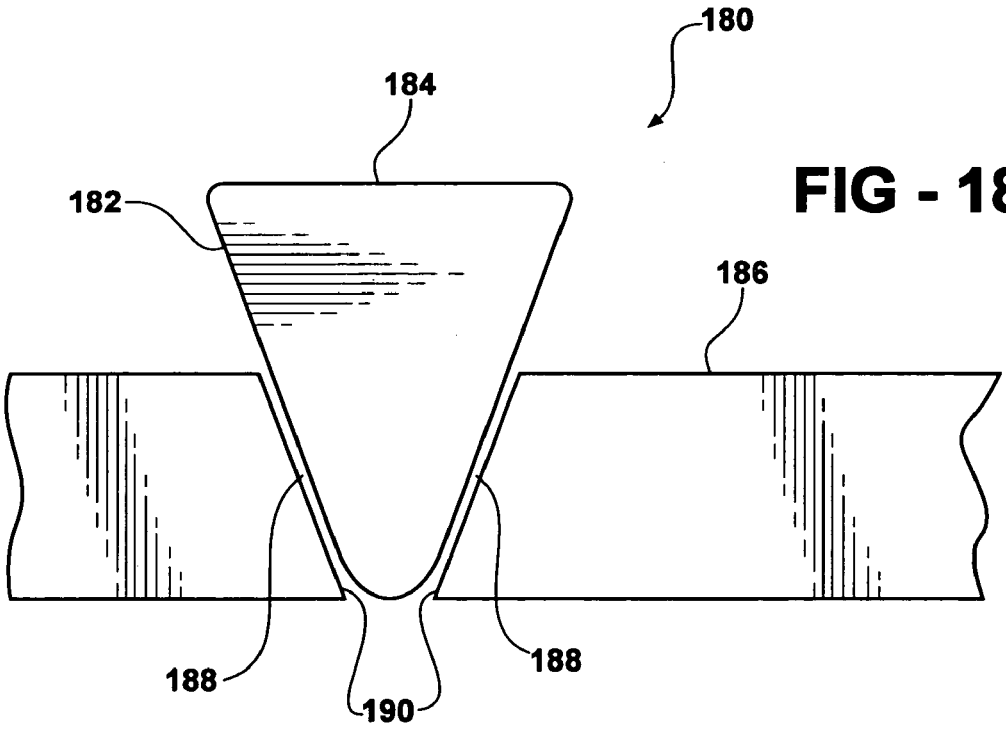

Referring finally to FIGS. 18A and 18B illustrated, respectively, are pre 178 and post 180 actuating positions associated with a selected and downwardly extending pressure switch, and in particular illustrating the manner in which upward displacement of the element relative to the seat aperture facilitates operation as an air pressure valve. The relief valve typically includes a substantially triangular (or conical) shape, see at 182 in each of FIGS. 18A and 18B.

FIG. 18A illustrates the air relief valve in a rest position and by which a top planar surface 184 is positioned substantially flush with a corresponding surface, see at 186 associated with the seat. The conical shaped element 182 is spring biased in a direction illustrated in FIG. 18A and so as to maintain a flush mating appearance relative to the surface 186 of the seat body.

Upon the instance of a user downwardly depressing the seat against the supporting bowl rim, the upward deflection of the conical shaped valve elements 182, see now FIG. 18B, results in the creation of a space 188 between it and the body of the seat to be created, this being further due to the angled and mating configuration of the associated side walls 190 defined in the seat and within which the conical air relief valve body mates.

Having described my invention, other and additional features will become apparent to those skilled in the art to which it pertains and without deviating from the scope of the appended claims.

The invention claimed is:

1. A multi-function toilet seat, comprising:

a seat having a body including an oval and arcuate shaped portion, defining an ergonomically configured upper surface and an open interior, a rear portion interconnecting opposite extending ends of said arcuate shaped portion;

a fluid inlet plug extending from a first location associated with said body and communicating with a plurality of succeeding and interior extending passageway channels, said channels communicating in turn with a plurality of spray nozzles located at spaced locations along an inner defining surface of said seat; and a suction outlet extending from a second location associated with said body and communicating with an exhaust motor incorporated into said rear portion, a plurality of exhaust apertures extending along spaced inner locations of said seat and evacuating an airflow from within an associated toilet bowl interior and through said suction outlet.

2. The multi-function toilet seat according to claim 1, further comprising a first switch located at an exterior location of said seat for activating a pressurized water supply through said spray nozzles, a second switch activating said exhaust motor.

3. The multi-function toilet seat according to claim 1, said exhaust motor including a two-directional switch to function as a drying motor for introducing a heated airflow through said rearward apertures.

4. The multi-function toilet seat according to claim 1, said function comprising at least one of a pressure-sensitive foot post extending from an underside location of said seat or a remote control and for activating at least one of washing, odor evacuation, or drying stages associated with said seat.

5. The multi-function toilet seat according to claim 1, further comprising a lid pivotally associated with said seat.

6. The multi-function toilet seat according to claim 1, further comprising at least one of the functions of soap and fragrance dispensing.

7. The multi-function toilet seat according to claim 1, further comprising at least one air relief valve defined in said body.

8. The multi-function toilet seat according to claim 7, said valve further comprising a pressure sensitive and biased conical shaped body displaceable relative to a location of said body.

9. The multi-function toilet seat according to claim 1, further comprising a projecting and repositionable pipe associated with a recessed toilet bowl location, said pipe having a specified shape and size and selectively repositionable to issue a fluid spray in an upward direction relative to the open interior of the seat body.

10. The multi-function toilet seat according to claim 1, further comprising at least one charcoal compartment incorporated into said body.

11. The multi-function toilet seat according to claim 10, further comprising a water holding compartment incorporated into said seat body and communicable with said fluid inlet plug.

12. A multi-function toilet seat assembly, comprising:

an arcuate shaped and interiorly open seat defining an ergonomically configured upper surface and an open interior;

a fluid inlet plug extending from a first location associated with said body and communicating with a plurality of spray nozzles placed at locations along an inner extending surface defining said open interior; and a lid pivotally secured to said seat, an exhaust motor incorporated into said lid and evacuating an airflow from within an associated toilet bowl interior and through a plurality of vents formed in said lid.

13. The multi-function toilet seat assembly as described in claim 12, said lid further comprising a projecting air channel in communication with an exhaust defined in said seat.

14. The multi-function toilet seat assembly as described in claim 12, further comprising an access door defined in a rear surface of said lid, a charcoal filter being supported against a surface of said access door and in proximity to said exhaust motor.

15. The multi-function toilet seat assembly as described in claim 12, further comprising a plurality of axially slidable supports extending from underside locations of said seat and for adapting to differently sized toilet bowl rims.

16. The multi-function toilet seat according to claim 12, further comprising at least one air relief valve defined in said body.

17. The multi-function toilet seat according to claim 16, said valve further comprising a pressure sensitive and biased conical shaped body displaceable relative to a location of said body.

18. The multi-function toilet seat according to claim 12, further comprising at least one charcoal compartment incorporated into said body.

19. The multi-function toilet seat according to claim 12, further comprising a water holding compartment incorporated into said seat body and communicable with said fluid inlet plug.

20. A multi-function toilet seat assembly, comprising:

an arcuate shaped and interiorly open seat defining an ergonomically configured upper surface and an open interior;

a fluid inlet plug extending from a first location associated with said body and communicating with a plurality of spray nozzles placed at locations along an inner extending surface defining said open interior; and a tank lid including inlet and outlet tubes extending from first and second locations and which are in operative communication with additional vacuum apertures defined in said seat, a motor/pump and filter assembly securing upon an underside surface of the tank lid and discharging said air through said lid.

* * * * *

UNITED STATES PATENT AND TRADEMARK OFFICE

CERTIFICATE OF CORRECTION

PATENT NO. : 7,216,374 B2
APPLICATION NO. : 11/099009
DATED : May 15, 2007
INVENTOR(S) : Hassan It is certified that error appears in the above-identified patent and that said Letters Patent is hereby corrected as shown below:

On the cover page,

[*] Notice: Subject to any disclaimer, the term of this patent is extended or adjusted under 35 USC 154(b) by (33) days Delete the phrase "by 33 days" and insert -- by 159 days --

Signed and Sealed this

Seventh Day of July, 2009

JOHN DOLL
*Acting Director of the United States Patent and Trademark Office*